US009737457B2

(12) United States Patent
Allen

(10) Patent No.: US 9,737,457 B2
(45) Date of Patent: Aug. 22, 2017

(54) SEXUAL APPLIANCES PROVIDING IMPROVED STIMULATION OF GRAFENBERG AREA

(71) Applicant: Eugene Allen, Metairie, LA (US)

(72) Inventor: Eugene Allen, Metairie, LA (US)

( * ) Notice: Subject to any disclaimer, the term of this patent is extended or adjusted under 35 U.S.C. 154(b) by 505 days.

(21) Appl. No.: 14/254,727

(22) Filed: Apr. 16, 2014

(65) Prior Publication Data

US 2014/0309565 A1 Oct. 16, 2014

Related U.S. Application Data

(60) Provisional application No. 61/812,273, filed on Apr. 16, 2013.

(51) Int. Cl.
*A61H 19/00* (2006.01)
*A61H 23/00* (2006.01)
(Continued)

(52) U.S. Cl.
CPC ..... *A61H 19/34* (2013.01); *A61H 19/44* (2013.01); *A61H 23/02* (2013.01); *A61H 23/0263* (2013.01); *A61H 23/04* (2013.01); *A61H 2201/0103* (2013.01); *A61H 2201/0207* (2013.01); *A61H 2201/0214* (2013.01); *A61H 2201/123* (2013.01); *A61H 2201/1215* (2013.01); *A61H 2201/149* (2013.01); *A61H 2201/1436* (2013.01); *A61H 2201/1669* (2013.01); *A61H 2201/1678* (2013.01);
(Continued)

(58) Field of Classification Search
CPC ..... A61H 19/34; A61H 23/04; A61H 23/02; A61H 23/0263; A61H 19/44; A61H 2201/123; A61H 2201/5038; A61H 2201/149; A61H 2201/0207; A61H 2201/1215; A61H 2201/5002; A61H 2201/1669; A61H 2201/5035
See application file for complete search history.

(56) References Cited

U.S. PATENT DOCUMENTS 7,530,944 B1 * 5/2009 Kain ..... A61H 19/34 600/38
2009/0093673 A1 * 4/2009 Lee ..... A61H 19/34 600/38
(Continued)

*Primary Examiner* — Quang D Thanh
(74) *Attorney, Agent, or Firm* — Norton IP Law Firm; Taylor M. Norton

(57) ABSTRACT

Handheld sexual appliances are disclosed herein, providing improved stimulators for stimulation of the Grafenberg area or G-spot of the female genitalia. The appliances generally comprise an elongate body having a first span, wherein is a handle region, and a second span that is angled upwards from the first span. In the second span, embodiments for stimulating the Grafenberg area are provided, comprising one or more of a mechanical finger that oscillates in a reciprocal motion within a protuberance that protrudes from the dorsal surface of the second span. In some embodiments, one or more stimulators simulates a range of motion of the back-and-forth movement of one or more human fingers. Thereby, the G-spot stimulating embodiments may directly impinge upon the Grafenberg area when inserted into the vagina, while the precise angle and force of that interaction can also be finely adjusted.

7 Claims, 4 Drawing Sheets

(51) Int. Cl.
*A61H 23/02* (2006.01)
*A61H 23/04* (2006.01)

(52) U.S. Cl.
CPC ..... *A61H 2201/5002* (2013.01); *A61H 2201/5035* (2013.01); *A61H 2201/5038* (2013.01)

(56) References Cited

U.S. PATENT DOCUMENTS

| | | | | |
|---|---|---|---|---|
| 2009/0099413 | A1* | 4/2009 | Kobashikawa | A61H 19/34 600/38 |
| 2011/0218395 | A1* | 9/2011 | Stout | A61F 5/00 600/38 |
| 2012/0215141 | A1* | 8/2012 | Peddicord | A61H 9/0078 601/46 |
| 2013/0261385 | A1* | 10/2013 | Zipper | A61H 19/40 600/38 |
| 2013/0345501 | A1* | 12/2013 | O'Reilly | A61H 19/44 600/38 |

* cited by examiner

SEXUAL APPLIANCES PROVIDING IMPROVED STIMULATION OF GRAFENBERG AREA

This application claims the benefit of U.S. Provisional Application No. 61/812,273 to Allen filed on Apr. 16, 2013 under 35 U.S.C. §119(e), the entirety of which is hereby incorporated by reference for all purposes.

BACKGROUND OF THE INVENTION

1. Field of the Invention

The present invention relates generally to the field of sexual appliances and sexual stimulation parephernalia, as in U.S. Class. No. 600/38; and in particular this invention claims methods and apparatus directed to a sexual appliance specially adapted to improve stimulation of the Grafenberg area ("G-spot") during simulated copulation by comprising means for applying not only vibration but also mechanical palpitation and/or directional motion at points of contact with the G-spot.

2. Description of the Related Art

The following review of related art is intended to provide edifying examples of problems and pitfalls in the design and use of sexual appliances, which are defined according to U.S. Class. No. 600/38 as "subject matter which comprises means to substitute for or enhance the act of human copulation." The mention of these examples does not constitute an admission that any of the following methods or devices constitute prior art applicable to the present invention, and the term prior art is used colloquially rather than as an explicit admission of any specific legal relationship between the subject matter of a reference discussed herein and the present invention, unless the mention of said reference includes specific language comprising a disclaimer stating that a particular prior art reference anticipates or reads upon the claims of the present invention. The discussion of the references states what their authors assert, and the applicant reserves the right to challenge the accuracy and pertinency of any of the documents cited herein.

The prior art provides numerous varieties of sexual appliances for stimulating the female genitalia and its erogenous zones, but very few that provide adequate or specialized mechanisms for stimulating the Grafenberg area. This is partly due to the fact that this erogenous zone is not well understood by technicians, physicians, and even women. The Grafenberg area, or "G-spot," can be defined as an erogenous area of the vagina that, when stimulated, may lead to strong sexual arousal, powerful orgasms and female ejaculation. Sexologists assert that it is typically located 1-3 inches (2.5-7.6 cm) up the front (anterior) vaginal wall between the vaginal opening and the urethra and is a sensitive area that may be part of the female prostate. Not all experts are yet convinced the area is structurally and functionally equivalent among all women, but this is increasingly becoming the minority view.

Prior art devices may have been capable of contacting the G-spot if consciously manipulated by the user having a knowledge of the area's position and function, but these devices do not provide particularized shape or ideally suited mechanical operations which would improve or enhance either the activation or discovery of the G-spot without the user deliberately focusing upon such application. Among the few prior art devices that allege to provide G-spot stimulating adaptations, through statements made in product labeling or by structural modifications and such, these apparatus address this function relatively clumsily and haphazardly, demonstrating a lack of detailed knowledge about the optimum type of stimuli appropriate for maximum results.

For example, U.S. Pat. App. Pub. No. 2014/0088470 (application Ser. No. 14/094,558) to Topolovac, et al., entitled, "Vibratory Actuator and Device for Sexual Stimulation," published Mar. 27, 2014 (filed Dec. 2, 2013) describes an interaction module having a vibratory actuator within an elongated member allegedly "suitable" for inter-vaginal stimulation, and a second vibratory actuator within a short curved member for simultaneous clitoral stimulation (at paragraph [0031]). However, the inter-vaginal member has the same overall shape as any other sexual appliance known in the art, without any particular modification specific for novel or advantageous G-spot stimulation.

U.S. Pat. App. Pub. No. 2014/0024980 (application Ser. No. 13/554,759) to Ortiz, entitled, "Medical Sexual Stimulator," published Jan. 23, 2014 (filed Jul. 20, 2012), describes a J-shaped sexual appliance resembling a candy cane comprising a tubular housing and a mechanism is for vibrating the tubular housing, where the J-shape causes the proximal end (handle) to point upwards to enable self-stimulation. However, the J-shape creates an awkward mechanical advantage whereby the user must pull upwards and way from the body in order to apply pressure directly against the Grafenberg area (although this drawback is claimed to be offset by the appliance's reduced tendency to cause strain to the wrists of the person who is self-applying it). U.S. Pat. App. Pub. No. 2013/0261385 (application Ser. No. 13/828,445) to Zipper, entitled, "Sexual Stimulation Device Using Light Therapy," published Oct. 3, 2013 (filed Mar. 14, 2013), discloses a plurality of vibrators for mechanical stimulation of the vagina, clitoris, or both. This apparatus has somewhat of a "U" shape but lacks any curvature in the distal region for insertion into the vagina and therefore does not directly impinge upon the Grafenburg area.

U.S. Pat. App. Pub. No. 2013/20130109913 (application Ser. No. 13/662,098) to Imboden et al., entitled, "Systems, Devices, and Methods for Personal Massage," published May 2, 2013 (filed Oct. 26, 2012) discloses a massage apparatus having a portion that rests against the clitoris and a portion that inserts partway into the vagina, intending to contact the G-spot; however, the two ends are connected by a flexible band which does not allow independent focus on the G-spot, and it lacks a handle region that a user may hold with a hand to adjust the depth and angle of insertion of the end that is intended to contact the G-spot. Therefore, the inter-vaginal portion cannot be manipulated directly against the G-spot, because it has no handle to provide such leverage and aim.

U.S. Pat. App. Pub. No. 2014/0088468 (application Ser. No. 14/037,560) to Murison, Entitled "Methods and Devices for Fluid Driven Adult Devices," published Mar. 27, 2014 (filed Sep. 26, 2013) discusses the disadvantages of the prior art with respect to linear cylindrical vibrating inter-vaginal devices, as follows: "Such electric motors with off-axis weights cannot easily operate at low frequencies when seeking to induce excitation to the user in a manner that mimics physical intercourse and stimulation where for example stimulation would be very low or low frequency and high or very high amplitude. Such low frequency, high amplitude vibrations are desirable to users but are not achieved with the vibrators of the prior art. For example providing operation below 40 Hz, below 10 Hz, below 4 Hz, below 1 Hz cannot be provided where small DC motors cannot produce much torque at low revolutions per minute (RPM) and therefore cannot move the large heavy weight to produce high amplitude variations. Typically, several thousand RPM is required in this scenario. Accordingly, reducing the weight to reduce torque required leads to reduced vibrations. It is this mode that vibrators operate within through high frequency low amplitude vibrations. It would be beneficial for an alternative drive means to allow low and very low frequency operation discretely or in combination with higher frequency operation and provide user settable high amplitude stimulation as well as offering reduced amplitudes." The application then goes on to propose a fluid-driven solution to the problem, in order to overcome the insufficiency of vibrators alone to provide maximal G-spot stimulation.

In light of the above, there exists a need for a sexual appliance that is optimized with respect to both its shape and its mechanical stimulating means for stimulating the Grafenberg area and the G-spot in order to increase the effectiveness of the devices in this art and to properly excite the nerve endings in the pelvic region related to female orgasm. More efficient stimulation of G-spot leads to higher levels of pleasure, more powerful orgasms, as well as reduced time needed in order to induce orgasm, as well as reduced power consumption for an appliance used therefor.

SUMMARY OF THE INVENTION

The present invention satisfies the above needs. It is an objective of the present invention to provide a sexual appliance that is specially adapted to enhance erotic pleasure and/or orgasm by providing improved means for contacting and stimulating the Grafenberg area ("G-spot"). The apparatus of the invention may also be regarded as a sex toy, a sexual-aid, a dildo, or an object or device used to facilitate human sexual pleasure, to stimulate a sex organ of a person, and to assist or replicate therapeutic investigations such as those performed by sexologists or intimacy coaches and the like, and/or to explore and experiment with various modes of stimulation of a sex organ for the purposes of arousal, achieving orgasm, sexual education or instruction, or participating in any of an array of interactive sexual activities. Sexual appliances of the present invention may comprise either or both vibrating and/or non-vibrating means for stimulating male and/or female genitalia, sexual organs, and/or erogenous zones. Although individual anatomical characteristics vary from person to person, it is believed that the G-spot is associated with an internal aspect of the clitoris and/or the "female prostate," which is medically named the "Skene's gland;" and which gland is located in the general area of the vulva on the internal anterior (abdominal) wall of the vagina around the lower end of the urethra, comprising a pair of ducts leading to the surface of the vulva, which structures are believed to be the source of female ejaculation (a release of fluid that may emerge during female orgasm). The present invention considers all of these glands, regions, and features of the female anatomy to be related to the Grafenberg area, so that term and its synonym "G-spot" are used to generally encompass the entire assortment of them, and to apply to any and all internal anatomical features associated with female orgasm and female ejaculation on the interior anterior wall of the vagina, unless otherwise expressly stated in a particular description of any given embodiment or utility herein throughout this disclosure. The G-spot may be isolated as one particular part of anatomy within this larger Grafenberg area on the front wall of the vagina, and these environs may encompass an area spanning up to one or more inches, and in some cases even spread out disjunctively along the internal anterior surface of the vagina. Nevertheless, the invention is equally applicable to any one part or all of these parts of the female anatomy, and it enables a user to focus on the G-spot directly or the region generally, according to whichever peculiar tastes and anatomical conditions apply to her at the time (and variation among women is considerable): and so therefore all of these features and considerations are referred to as simply the Grafenberg area or the G-spot, broadly and interchangeably, for the sake of simplicity throughout this disclosure, unless otherwise explicitly stated. Furthermore, note that present invention is also intended to be capable of stimulating any other part of the vagina or any other sex organ, any other part of the body related to relaxation, pleasure, orgasm, or sexual arousal and the like in either males or females, including but not limited to the clitoris, labia, vulva, perineum, anus, rectum, prostate gland, Skein's gland, urethra, penis, scrotum, nipple, breast, areola, mouth, lips, throat, and so on.

The various embodiments of the invention relate to an improved apparatus specially adapted for optimally exploring and stimulating the Grafenberg area in at least three complementary and synergistic ways; firstly, by providing a mechanical leverage in the angled shape of the longitudinal dimension of the device as a whole, secondly by providing an appropriate and deliberately front-facing G-spot stimulating means near the distal end of the device which is insertable into the vagina at the optimum geometry for applying stimulus and variable force to the Grafenberg area of the internal anterior/abdominal wall of the vagina within one to five inches, or thereabouts (depending on individual anatomy) from the vulva or clitoris (i.e., the entrance into the vaginal orifice), and thirdly, by providing one or more ideal or particularly appropriate stimuli comprising motors imparting not merely vibratory but also tactile stimulation within and upon the Grafenberg area. In its typical configuration, the apparatus comprises a generally cylindrical elongate body having a length that may range between about six inches and up to twenty or more inches, depending on the assortment of variable elements provided within or upon it; where the terminal end nearest to a handle portion is regarded as the proximal end, and where the opposite end which is for insertion into the vagina (or other orifice) is regarded as the distal end. Just proximal to the distal end, the apparatus comprises the G-spot stimulating means for directly stimulating the Grafenberg area (and/or G-spot), said means comprising one or more mechanical stimulating means housed within a protubernace such as a bulb, flange, or other protruding portion of space coextensive with the internal space of the body wherein is housed one or more mechanical stimulus-inducing devices. The position and orientation of this protuberance directs these G-spot stimuli from the stimulus-generating elements upwards (dorsally) from the top side of the body of the apparatus; or, in some cases, the G-spot stimulating means may flare out laterally somewhat from the lateral sides of the body to achieve the same result with an expanded surface area or with capacity to deliver more power (e.g., by housing larger or multiple or differently aligned motors and/or other mechanical elements simultaneously). The different embodiments of the apparatus may provide various configurations of the one or more G-spot stimulating elements within the G-spot stimulating protuberance, but in general they are positioned flush against the outermost layer of the body of the apparatus (e.g., flush against the underside of the outer sheath, or external casing, coating, layer, or any other material element of the composition of the body of the apparatus). Thereby, a female user may hold the handle of the appliance at or near the proximal end while the device is oriented with its dorsal side "up,"

such that at the distal end of the apparatus, the dorsal surface thereof is oriented "upwards" to contact the inner wall of the front (anterior/abdominal) region of her vagina; and thereby the G-spot stimulating means will directly impinge upon the Grafenberg area in a preferred position, while the precise angle and force of that interaction between the G-spot stimulating means and her Grafenberg area can also be finely adjusted by her control of the handle region and her making slight alterations thereby of the angle of entry which the appliance is making where it penetrates into her vagina. Simultaneously, she may operate controls in the handle region to adjust the mechanical behavior of the one or more stimulus-generation elements in the G-spot stimulating means, so that the preferences and anatomical requirements of any user may be explored and accommodated with extremely precise detail by direct and finely-controlled interactions between the G-spot stimulating means and the inner abdominal surface of the vagina, where said interactions may comprise dynamic mechanical action imparted by the stimulating means (motorized mechanical action) and/or directional force imparted by pressing the angled distal end portion of the apparatus into the vagina and against the internal surfaces therein.

The position of the G-spot stimulating means, and whichever of the various physical structures it takes in any particular embodiment (such as bulb, flange, ridge, and the like), is not variable in any one physical device, although its geometry and its effective distance from the extreme terminus of the distal end of the appliance may be altered in different makes and models of the various embodiments of the present invention. One way to impart variation in a particular apparatus is provided by way of an array of extension elements or adapters that fit onto said terminus of the distal end. These distal extension elements enable a woman, according to preference, to complement her desired direct G-spot stimulation with additional deeper penetration into the vagina, or with still further dynamic mechanical stimulating means, where the specifications of said variable extension features may adopt a wide range of alternatives. For example, one embodiment may comprise simply a cylindrical extension of the main body of the appliance so that it extends several inches distally beyond the G-spot stimulating means, linearly or at an angle; other embodiments may comprise various shapes and contain one or more additional mechanical stimulating elements such as vibrating motors, sonic and tactile electronics, expandable bladders, reservoirs or dispensing means for delivering fluids, lubricants, flavors, odors, or other ejecta from the apparatus, means for providing sensations relating to temperature, and so on to include any other functional capacity desirable for application via a sexual appliance. In still further embodiments, these extensible elements may comprise separate utilities that are only secondarily intended for application in the vagina but which, when applied to other parts of the body, impart additional sexual and sensual stimulating properties to the device (e.g., a series of bulbs arrayed like "beads on a string" which could be inserted into the anus in an alternative use). Alternatively and/or in addition, the same types of extensible elements may be attached at the proximal terminus of the apparatus so that the different uses of those extensible elements, the one at the proximal end and the other at the distal end, may be used independently of the other, or simultaneously with the other.

In order to enable the application of optimum leverage, mechanical advantage, appropriate range of motion, and targeted contact between the G-spot stimulating means located in the distal region of the apparatus, the generally cylindrical body of the device is shaped longitudinally such that it comprises at least one elbow or joint located approximately one to six inches proximal to the G-spot stimulating means, or to disclose it in more general terms, located approximately two/thirds of the distance from the proximal to the distal end of the boy. In reference to the division imparted by the insertion of said elbow, the body of the apparatus therefore comprises a first proximal span (wherein is the handle; and which may be called the handle portion of the apparatus) that effectively traces a straight line in a first horizontal plane beginning at the proximal terminus and extending distally until, at said elbow or joint, the generally cylindrical body of the apparatus departs from said first horizontal plane and continues upwards therefrom extending onwards as a second span (the G-spot interaction span) which effectively traces a second horizontal line to at least the point on the body of the apparatus where the G-spot stimulating means is located. In alternative configurations, the apparatus may further comprise one or more additional sections (e.g., constituting a third span of the generally cylindrical body, and/or, constituting one or more of an extension or an adapter element) such that further changes in orientation or shape proceeding distally from the G-spot stimulating means of the second body span of the apparatus may also be present, depending upon user preferences and choice of any particular embodiment. In the preferred embodiment, the region distal to the G-spot stimulating means comprises a short span that effectively just continues the same angle of the second span of the generally cylindrical body, so that the G-spot stimulating means is not located at the most distal terminus of the apparatus, but is instead positioned proximally to the distal terminus by a distance of between a half inch to two inches. This positioning is important and is related to the limitation that the G-spot stimulating means not be oriented distally from the body of the apparatus, but instead be oriented dorsally or upwards from the top/dorsal surface of the second span.

In summary, the end-to-end shape of the appliance (i.e., the longitudinal shape of the generally cylindrical body), is bent upwards at said elbow or joint between the first and second spans at an angle between approximately forty-five and eighty degrees, wherein the most preferred angle (based on the anatomical features of the average woman) is approximately 65 degrees, such that when the second span is inserted into the vagina the optimum contact and interactivity are obtained where the G-spot stimulating means impinges upon the Grafenberg area, and such that the maximum sensitivity, control, leverage, comfort, and satisfaction are achieved by manipulation of the first span of the handle while said second span is inserted into the vagina. If, as in prior art devices, too slight of an angle where employed in a sexual apparatus having an elbow or curved intermediate portion, then the mechanical leverage is insufficient to bring the full range of force and maneuverability of any G-spot stimulating means against the inner front wall of the vagina (even if that stimulus were oriented upwards to aim directly at the Grafenberg area, which none of the prior art devices are known to provide); too great of an angle, and it is no longer possible to slide the apparatus deeper into the vagina while maintaining optimal contract between the G-spot stimulating means and the Grafenberg area and therefore the range of motion during use is thus severely limited, as well as are the scope of functional applications and alternative distal extensions that can be applied in variable embodiments. Non-optimal angles have other drawbacks which are apparent from the previous discussion of the prior art and which are also discussed where relevant throughout the detailed description section herein.

Thus, whereas prior art devices made it theoretically possible for an individual user of a sexual appliance to generally stimulate the Grafenberg area, the present invention is constructed to be practically ideal for discovering and exploring the G-spot and surrounding areas deliberately, not only as a collective region but also as individual anatomical substructures, even as they differ among individual women according to their genetic, anatomical, and behavioral traits, by virtue of the present invention providing the ideal mechanical advantages in its overall shape and structure, having the ideal configuration, orientation, sensitivity, and finely positionable ranges of motion and interactions necessary to enable a user to focus precise attention and energy upon the inner front wall of the vagina, broadly or with localized accuracy, using a handled sexual appliance to translate the fine motor skills of her hands into precise and intuitive responses from the G-spot stimulating means of the device.

Furthermore, the preferred embodiment of the G-spot stimulating means comprises a motor that provides a repetitive back-and-forth mechanical stimulus whereby one or more pedals stroke the Grafenberg area in an up-and-down motion (where up-and-down is parallel to the longitudinal axis of the female body, said longitudinal axis being her head-to-toe axis). Thus, via an oscillating motor or other means for causing a piston-like pedal to move backwards and forwards within a range of motion tracing a circular distance of several inches (e.g., anywhere from about one inch to about five inches) against the inner wall of the vagina in the Grafenberg area, thereby dual stimuli are applied comprising both pressure and stroking motion in optimal fashion by said repetitive mechanical stimulus. The path traced by the contact ends of the pedals may be referred to as a "come hither" motion as if one or more fingers on a human hand, where the palm is facing upwards, are curling forward and back again in the well-known gesture that beckons or invites another person to approach. Therefore, the terminal portion of the mechanical stimulating means may be referred to as a mechanical "finger" throughout this disclosure.

Regarding the body of the apparatus itself, in alternative embodiments, the angle (the "upwards trajectory") of the second span thereof may be adjustable to suit the preferences or anatomy of individual users via a mechanically adjustable means for adjusting the angle of the elbow or joint within a specified range of motion. Thus, the angle of the elbow may vary around the ideal angle of approximately 65 degrees, such as varying between 25 degrees and 85 degrees, in order to suit the unique preferences or anatomical distinctiveness of different users. In addition, the position and directionality of the individual vibrating motors or other stimulus-creating components located internally in the distal span(s) of the appliance may themselves be adjustable. Adjustability is managed by the user of the appliance through modulation of controller elements whose interfaces are located at the proximal end of the appliance and/or in and along the handle portion, where said modulation may be accomplished manually by the direct manipulation of features comprising any combination of switches, dials, buttons, and the like, or may be accomplished via the operation of same within a single control panel, and/or may be accomplished electronically and/or remotely, such as via computer-implemented means for commanding the operation of the appliance's various functional elements, which may or may not interface directly with any of said controls or control panels (e.g., wireless or remote means may bypass a physical interface and may instead communicate directly with internal components of the appliance).

It is a second objective of the present invention to provide a sexual appliance having multiple modes for stimulating multiple areas of a sex organ simultaneously, in addition to the Grafenberg area. In preferred embodiments, the appliance of the present invention comprises a first stimulating means for interacting directly with the Grafenberg area and a second stimulating means for interacting directly with the clitoris. Alternative analogous arrangements are contemplated for the anal region and/or the male anatomy (e.g., rectum and prostate). In the preferred embodiment, the position of the second stimulating means is fixed upon the dorsal surface (i.e., the "top" surface in all illustrations comprising side views provided in the drawings of this disclosure) between the handle and the G-spot stimulating means, but in other embodiments its position may be adjustable in any plane or dimension. In the preferred embodiment, the second stimulating means is the G-spot stimulating means which is located between one and four inches from the contact surface of the first stimulating means, because that is the experimentally determined optimum arrangement for enabling maximal stimulation simultaneously of both the G-spot and the clitoris in most women. By enabling this arrangement to be adjustable, as by lengthening or shortening the distance between the contact surfaces of the two simulating means, in any one particular embodiment users having anatomical features of non-average sizes, shapes, preferences and positioning may be accommodated.

Additional objects, features, and advantages of the present invention will be more readily apparent from the following detailed descriptions of some preferred embodiments thereof. The present invention is not limited in its application, details, or components merely to those set forth in the following description and illustrations. The present invention resides not merely in any one of the features set forth in this specification, but also in the particular combination of all of the features and improvements claimed. Methods and devices consistent with the present invention are capable of other embodiments. In general, the order of the steps of any processes disclosed herein may be altered within the scope of the invention. Also, the phraseology and terminology employed herein are for the purpose of description and should not be regarded as limiting unless explicitly stated as such.

DETAILED DESCRIPTION OF THE DRAWINGS

Figure 1:
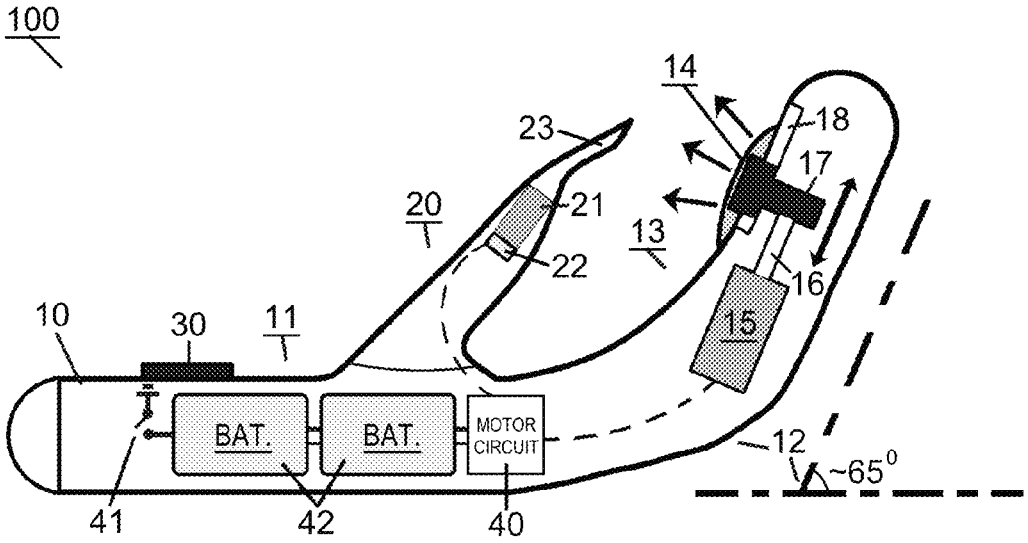
FIG. 1 is side view diagram of a cross section of a first embodiment of the sexual appliance of the invention wherein the stimulating means comprises a motor-driven stimulating finger that slides linearly back-and-forth in a reciprocating motion.

Throughout all the Figures, same or corresponding elements are indicated by the same reference numerals. Illustrations, in whole or with respect to any particular part, are not necessarily proportioned to scale, but some features may be altered in order to highlight particular structural and functional properties.

FIG. 1 shows a cross section through a side view of a device representing a first embodiment 100 of the sexual appliance of the present invention with the proximal end on the left and the distal end on the right of the drawing. The device 100 generally comprises a cylindrical body 10 having a first span 11 extending from the proximal terminus to an elbow 12, and a second span 13 extending from the elbow to the distal terminus, where the first span 11 is both a means for a user to grip and manipulate the apparatus during use and also comprises an electrical control panel 30 in some embodiments (although the control panel may be located on any part of the first span 11). The second span 13 comprises a means for stimulating the Grafenberg area 14. The angle at which the elbow 12 effectively causes the cylindrical body of the apparatus in the second span 13 to depart from the horizontal plane established by the first span 11 is illustrated in the drawings at a preferred value of about 65 degrees, such that when the second span 13 is inserted into the vagina with the top or dorsal side of the body 10 facing the abdominal or anterior wall therein, the G-spot stimulating means 14 is positioned flush against the Grafenberg area such that the maximum force and surface area of contact is communicated from the stimulating means 14 to the vaginal epithelium, thereby achieving the most efficient and direct stimulation of the underlying nerves; and, moreover, the user may finely adjust the angle and rotation of the apparatus via manipulating the first span 11 because the G-spot stimulating means directs its stimulatory action frontwards out of the second span 13. The mechanical force or other stimulating action(s) of the G-spot stimulating means 14 are focused to project away from the body 10 of the appliance at an angle perpendicular to the longitudinal axis of the body 10, which is to say, in the dorsal direction. This stimulatory action therefore enables the user to press the element 14 against the Grafenberg area to stimulate it fully across a distance range spanning one to three inches longitudinally (corresponding to the length of the element 14 in any particular model of the device, and/or according to the range of motion of the moving parts providing the stimulus therein, which range of motion may be adjustable via electronic controls), as illustrated by the three arrows extending directly outwards (dorsally) from the element 14 in FIG. 1. Moreover, the gently raised, curved, or protruding shape of the G-spot stimulating means 14 (the "protuberance") where it resides on the outer surface of the body 10 of the apparatus is ideally suited to conform to the natural contour of the inner vaginal wall in the Grafenberg area. The same form-fitting interaction is achieved with regard to the width of the element 14 in the Grafenberg area. To fully capitalize on the optimized shape and orientation of the element 14 provided by the particular construction of the present invention during use, the user may slide, twist, and/or or tilt the appliance to vary the directionality, force, and surface area of this contact, which thereby enables the user to vary the sensations achieved during use experimentally, so that the device enables the broadest possible range of stimulation for the Grafenberg area, from maximal to minimal, in any woman.

The specialized and variable mechanical motion of the G-spot stimulating means 14 is a further advantage of the present invention, and in the embodiment of FIG. 1, this motion comprises the back-and-forth sliding motion of a stimulator 17 (called a "finger" to convey the intent that the G-spot stimulating means should provide a sensation resembling that of one or more human fingertips interacting with the Grafenberg area) resembling a piston attached to a reciprocating motor 15 via an armature 16. The double-headed arrow indicates the directions and range of motion of the back-and-forth movement of the "finger" 17 underneath the surface or sheath of the stimulating means 14. In other embodiments (such as that shown in FIG. 2, below) the range of motion of the finger 17 may be more of an ovoid path rather than the linear back-and-forth path).

The motor 15 may comprise any electric motor or equivalent subcombination, and in preferred embodiments it operates on current generated from one or more batteries housed within cylindrical body 10. In all of the preferred embodiments generally, the motor 15 drives a means for creating an oscillatory motion in a downstream object, preferably via a reciprocating arm, in order to produce the back-and-forth motion of the one or more fingers which mimics the massaging stimulatory action of the tips of human fingers, where the finger equivalent 17 is attached to a distal end of the arm opposite to the proximal end of the arm that engages the motor via any suitable arrangement of cranks and/or gears as would be understood by persons of ordinary skill in the relevant arts, namely the art of producing reciprocal or rotary mechanical motion where the output causes an arm, a finger-like massaging head, or other end-piece to trace a short path repetitively. The G-spot stimulating means in any embodiment may comprise one finger, or two fingers in parallel, or more. The mechanism driving the back-and-forth motion of the one or more fingers may also comprise a servo motor, a swing arm, a worm gear reciprocating assembly; or any equivalent means for generating rotary reciprocation. The gears mechanism conveying torque from the motor to the motion of the fingers may also comprise a crank means for causing oscillating movement of the fingers. The fingers themselves may be jointed, and/or they may terminate in a ball bearing or roller that rolls along the undersurface of the protuberance of the outer sheath or other membrane separating the internal components from the outside environment of the apparatus as the finger(s) moves through its range of motion beneath it, such that the point of contact between the finger element and said undersurface of the protuberance experiences less friction, less shearing force, less wear and distension, and/or smoother passage across the area of contact in the range of motion of the distal terminus of the finger along said undersurface of the protuberance. The precise mechanical configuration of the motor and drive may vary according to each embodiment as appropriate for the desired mode of stimulation produced by the stimulating means in a particular circumstance or in a particular commercial variety of the apparatus.

The cylindrical body 10 may comprise a housing to define its overall shape overlaid with a flexible sheath or coating, such as surgical grade silicone. Alternatively, the cylindrical body 10 may comprise a molded plastic or rubber layer overlaid upon an internal frame of plastic, metal, or other study material, where said frame connects to each of the internal components in order to hold them and orient them in their locations as illustrated in the drawings. The methods and means for constructing the cylindrical body according to these various equivalent options are understood by persons of ordinary skill in the relevant arts.

The embodiment 100 of FIG. 1 also comprises a second means 20 for stimulating a second part of the female body, namely, the clitoris. Said second stimulating means 20 comprises a scaffold for supporting a small vibrating motor 21 above the dorsal surface of the body 10 of the device, approximately 2 to four inches above the body 10, and approximately one to four inches away from (proximal to) the G-spot stimulating means 14. In the preferred embodiment, the second stimulating means 20 terminates in a brush 23, where said brush 23 comprises a resilient or flexible appendage, such as the two appendages resembling "rabbit ears" 23 in FIG. 1, as a means for providing direct tactile stimulation to the clitoris and/or for transferring the vibration of said motor 21 to the clitoris.

Motor 21 may be powered by the same power supply that operates the motor 15 of the first stimulating means 14, or it may be powered by a separate motor or battery 22. The control panel 30 provides means for switching 41 on or off the one or more motor circuits 40, which in FIG. 1 receive current from batteries 42. In other embodiments, AC current from a power cord (not shown) may also provide current to the one or more motor circuits 40.

Figure 2:
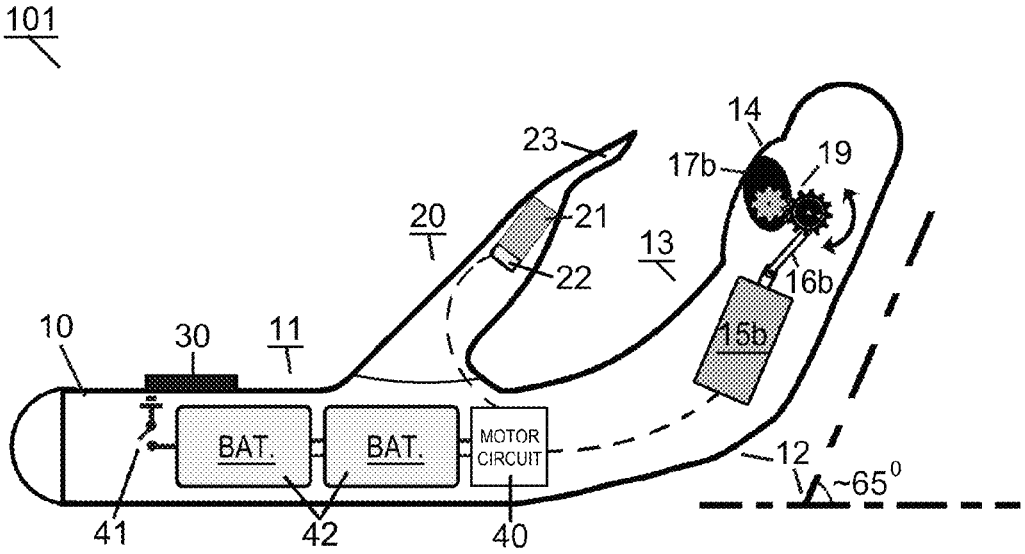
FIG. 2 is side view diagram of a cross section of a second embodiment of the sexual appliance of the invention wherein the stimulating means comprises a rotating cam driven by a motor such that the stimulating finger traces an ovoid path.

FIG. 2 shows a second embodiment 101 of the sexual appliance of the present invention where the apparatus differs from the first embodiment 100 only in the mechanism of the G-spot stimulating means 14. In this second embodiment, the finger 17*b* comprises a cam connecting to shaft 16*b* via gears 19. Motor 15*b* is a reciprocating motor or servo motor. The cam slides against and pushes against the undersurface of the outer sheath of the body 10 of the apparatus while tracing an ovoid motion, thus simulating the motion of a human hand when the middle fingers are gesturing in a "come hither" signal, within the protuberance of the G-spot stimulating means 14. The back-and-forth motion is represented by the curved double-headed arrow. Any other arrangement of gears and leverages may be applied to create numerous and variable ranges of motion of the fingers in order to provide the user with a multiplicity of sensory experiences via the G-spot stimulating means 14. Furthermore, instead of an electric motor 15, the mechanical power source for driving the back-and-forth motion of the fingers 17 in any embodiment may comprise other suitable means for generating motile or reciprocating force, as understood by persons of ordinary skill in the relevant arts, including but not limited to an electronically controlled pump apparatus. In other embodiments, the finger element may comprise one or more pin-like levers moving in a "scissor" or "windshield-wiper" motion from an anchor point within the protuberance 14, such that the unanchored end (the protruding end that applies stimulus to the vaginal wall) is waving back-and-forth or side-to-side in order to achieve an arcuate range of motion at the distal end, such as in the "come hither" motion.

Figure 3:
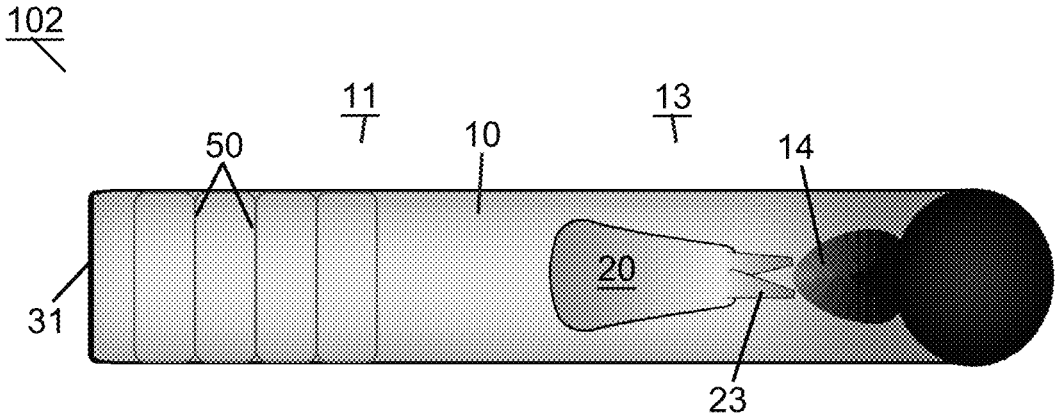
FIG. 3 is a top view of the first embodiment of the sexual appliance of the invention.

FIG. 3 is a top view of a typical embodiment 102 of the sexual appliance of the present invention in which the control panel 31 (not shown, but see FIG. 4, below) is located on a plate at the proximal end of the body 10 of the device. As in all the drawings, the proximal end is illustrated on the left and the distal end on the right. The means 50 for gripping the device 102 by a user during use are symbolized by striations 50 which may be a texture imparted into the outer surface of the body 10 itself or a distinct handle material affixed thereto, such as a molded rubber padding or foam cushion.

Figure 4:
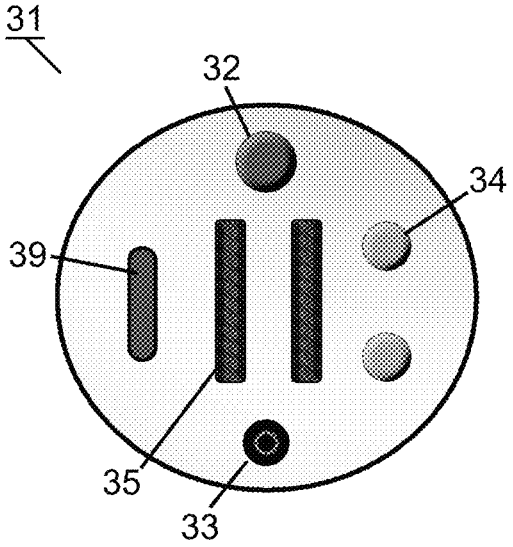
FIG. 4 is a front view of an interface and control panel in an endplate at the proximal end of an embodiment of the sexual appliance of the invention.

FIG. 4 is a side view of the face of the plate constituting the proximal end of the apparatus 102 wherein is the control panel 31, said control panel 31 comprising various electrical buttons and switches as well as electronic control means for regulating the one or more motor circuits 40 within the device. A power button 32 turns the apparatus on and off. An AC port 33 connects to an external power supply such as an AC outlet, which port may also regulate a battery charging means for recharging internal batteries (not shown), such as a coaxial charging jack. One or more activity control switches or buttons 34 set the behavioral parameters for the performance of the various internal functional components 34, which may be complemented by amplitude adjustment means for determining the rate or patterns of said performance(s), such as by one or more slide switches or wheels 35. These control means are primarily symbolic in the drawing and may be substituted with any appropriate equivalents as understood by persons of ordinary skill in the art. Depending upon the sophistication of any particular embodiment of the invention, electronic circuits may further regulate said performance(s) and may interface with external personal computer devices through jacks and ports such as the USB port 39. Internally, electronic circuits may comprise microprocessors, wireless micro-transmitters/receivers, and memory storage means. Externally, software operating on said personal computer may assist the user in controlling and programming said performances.

Figure 5:
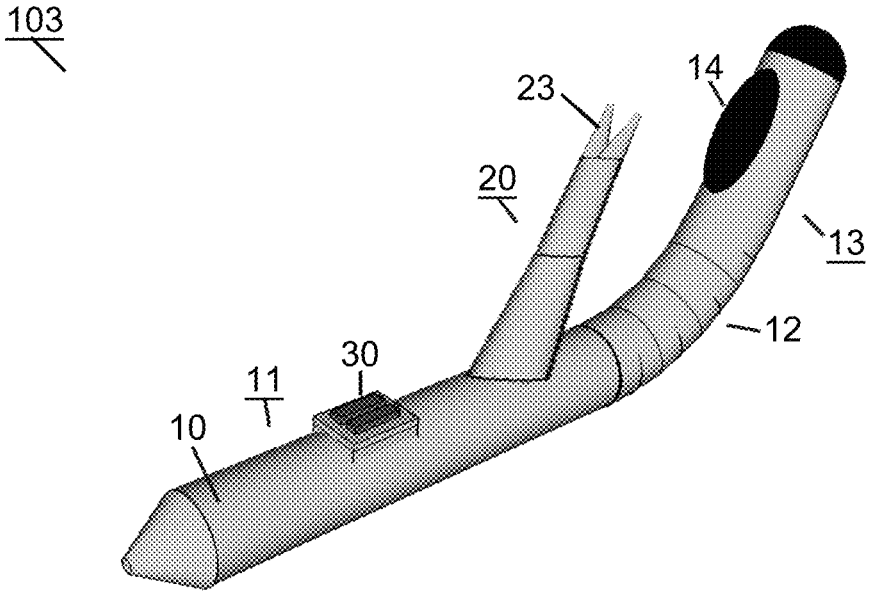
FIG. 5 is a front left perspective view of a third embodiment of the sexual appliance of the invention wherein the representation of the stimulus means may correspond to that of either the first or the second embodiment previously illustrated in cross-section.

FIG. 5 is a front left perspective view of a typical embodiment 103 of the present invention illustrating the locations of its principal external features. At the proximal end of the body 10 of the apparatus 103, a first section or span 11 comprises the region wherein the control panel 30 and gripping surface reside, effectively providing a handle. Towards the distal end of said first span 11, the scaffold of the secondary stimulation means 20 rises upwards and terminates in the brushes 23 for contacting the clitoris. Distally, in the main body 10 of the apparatus, the elbow 12 curves upwards into the second span 13 which extends at an angle of 65 degrees from the horizontal. About one inch proximal to the distal terminus of the body 10 within the second span 13 is the protuberance of the G-spot stimulating means 14, directed upwards and outwards from the body 10 to aim directly at the Grafenberg area. During use, the abdominal or anterior wall of the vagina contacts the G-spot stimulating means 14 inside the vagina while the brushes of the clitoral stimulating means 23 contact the clitoris on the outside of the vagina (the vulva). The first (G-spot) 14 and second (clitoral) 20 stimulating means are positioned opposite each other, separated by a certain distance and oriented in their respective angles, such that slight manipulations of the handle region 11 result in changes in the stimulatory effects of these components upon the female genitalia while they each nevertheless maintain stimulatory contact, simultaneously, upon their respective target of the female genitalia.

Figure 6:
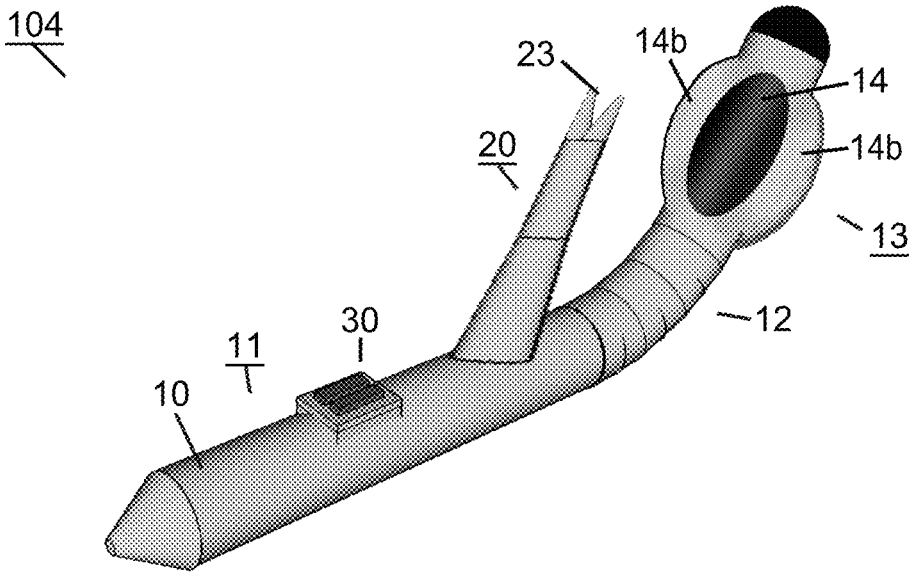
FIG. 6 is a front left perspective view of a fourth embodiment of the sexual appliance of the invention having a more complex stimulating means having a widened neck at the protuberance and comprising therein a reciprocating finger mechanism and two vibrating stimulators, one each side of said finger mechanism.

FIG. 6 a front left perspective view of a fourth preferred embodiment 104 of the present invention differing from the embodiment 103 only in features relating to the G-spot stimulating means 14, in that the body 10 surrounding the element 14 is expanded to flare outwards, deviating from the general cylindrical shape, so that larger, more, complex, and additional stimulatory elements may be included within the body to augment the mechanical features of the G-spot stimulating means 14. For example, this general structure is illustrated in cross-section below in FIG. 8B, wherein the mechanism comprises dual fingers 17*b* flanked by dual vibrating motors 21 housed within the flanges of the flaring regions of the body 10. The three-dimensional shape of the flared regions 14*b* of the body 10 may be more or less spherical, resulting in a range of shapes that resemble blubs (the most spherical of the range of shapes) or the head of a cobra snake (the least spherical); and these shapes 14*b* provide a secondary utility by increasing the size or circumference of the second span 13 of the appliance where it penetrates into the vagina.

Figure 7:
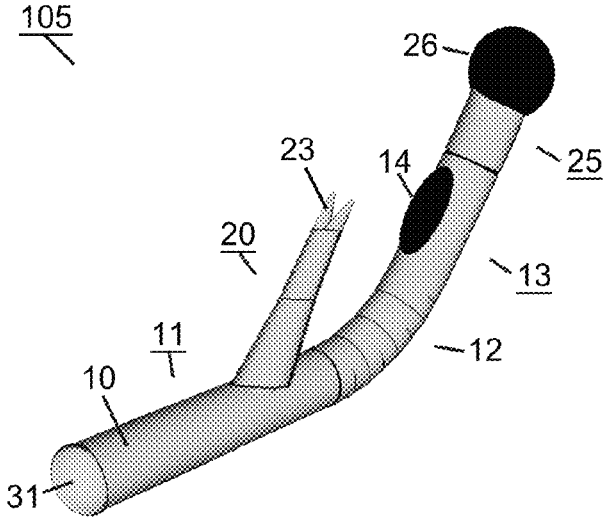
FIG. 7 is a front left perspective view of the third preferred embodiment of the sexual appliance of the invention, further comprising a first example of an extension element at the distal terminus of the body of the appliance.

FIG. 7 a front left perspective view of an embodiment 105 of the present invention differing from the embodiment 103 in the addition of an extension element 25 at the distal end of the second span 13, where said extension element 25 effectively comprises a third span of the cylindrical body 10 of the device. The extension element 25 adds further length to the body 10 of the apparatus and volume or mass, as in the bulb 26 capping its distal end, which is an option to provide deeper penetration in conjunction with the other stimulating means of the apparatus. This and other extension elements 25 may be attached via a screw-on means for replacing the former distal end cap of the embodiment 103 (by unscrewing it) and then attaching the proximal end of the extension element 25 by tightening it down upon the threads exposed beneath the removed end-cap.

Figure 8B:
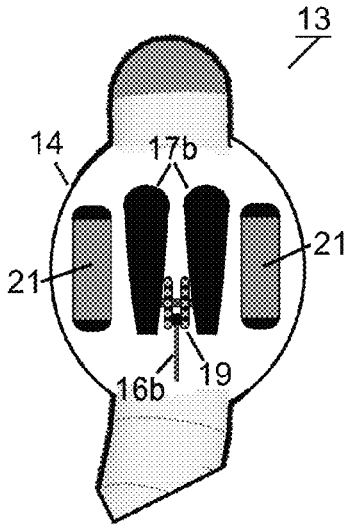
FIG. 8B is a front view of a cross section of the second/distal span of the fourth preferred embodiment of the sexual appliance.
Figure 8A:
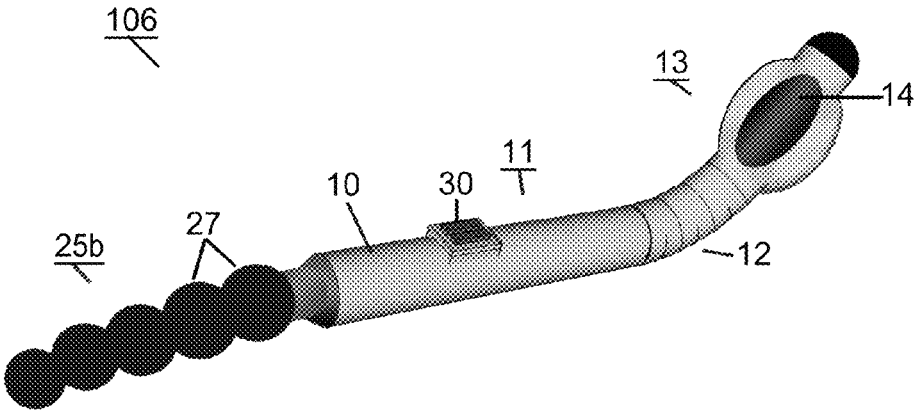
FIG. 8A is a front left perspective view of the fourth preferred embodiment of the sexual appliance of the invention, further comprising a second example of an extension element at the proximal terminus of the body of the appliance.

FIG. 8A is a front left perspective view of an embodiment 106 of the present invention differing from the embodiment 104 in two ways, where one difference is the absence of the second stimulation means 20, and the other difference is the addition of an extension element 25*b* at the proximal end of the apparatus. FIG. 8B is a magnified front view of the bulb region 14*b* of the body 10 at the G-spot stimulating means 14 shown in cross section to reveal the internal mechanical components. The motor-driven finger mechanism here is similar to that in previous FIG. 2, comprising two cams 17*b* connected to a shaft 16*b* via a series of gears 19, yielding an ovoid range of motion of the outer edge of the cams 17*b* such that a sensation is perceived by the user resembling two fingers moving in a "come hither" gesture. Moreover, two separately powered vibrating motors 21 are positioned laterally to the cams 17*b* to enhance the overall stimulation yielded by the G-spot stimulating means 14 by augmenting both the energy and complexity of the total stimulus being directed towards the Grafenberg area and the G-spot therein.

Vibrating motors may be provided in any form known, or equivalent thereof, to persons of ordinary skill in the art. Vibratory stimulation typically occurs via an electromechanical actuator, such as an electric motor coupled to a counterweight, a piezoelectric transducer coupled to a mass, a charged diaphragm coupled to a mass, or any other linear or rotary actuator manipulating an (eccentric) mass to generate a vibration.

The mechanical action of the G-spot stimulating means in some embodiments can be characterized by persons of ordinary skill in the art as haptic stimulation. There are several types of haptic stimulation; one type involves stimulating nerves using non-vibratory mechanical motion, such as by bending, twisting, curling, flexing, elongating, or inflating. Another type utilizes actuators that apply forces to the skin for touch feedback, and controllers, such that the actuator provides mechanical motion in response to an electrical stimulus or tactile trigger. Yet other haptics enable actuators to incorporate pressure sensitivity, enabling a user to control the amplitude or other properties of the operation of a mechanical device according to the quantity of force or pressure applied against the actuator. Other stimuli which may be included in any of the stimulation means or extension elements of the present invention include a heating element, a cooling element, a linear or non-linear actuator, or any other suitable electrical, electromechanical, or electrochemical component.

The microcomponents of the various motor circuits used in the various embodiments herein comply with standard electrical conventions relevant to the art. Power-conditioning circuits can include a voltage regulator, a buck circuit, a boost circuit, or other suitable electric circuit that transforms the output of the battery into signal of desired voltage or current. For example, the battery can output a nominal 3.7V, and the power-conditioning circuit can boost the battery output voltage to 5.0V nominal to power a processor. Power-conditioning circuits can function in any other way to condition signals from the battery to power various components and systems within the apparatus. The circuit may further include a charging circuit that controls current and/or voltage signals across the battery leads as the battery 121 is charged. Where a microprocessor is present, it may regulate the electrical properties of any circuits; and it may be configured to enter a sleep state, such as after a threshold period of time without use and/or given a user input; and it may be programmed to provide complex patterns of stimuli via the various electrical, mechanical, and electronic components of the apparatus.

It should be emphasized that the above described embodiments of the present invention exemplify some, but not all, possible implementations of the present invention and have been set forth in order to provide a clear understanding of its qualities. Those skilled in the art will appreciate that the conception upon which this disclosure is based may readily be utilized as a basis for designing of other structures, methods, and systems for carrying out the several purposes of the present invention. The following claims should be regarded as encompassing equivalent and various constructions insofar as they do not depart from the spirit and scope of the methods and devices consistent with the present invention.

I claim:

1. A sexual appliance comprising:

An elongate body having a proximal end and a distal end divided by an elbow therebetween, said elongate body further comprises therein a first span extending from said proximal end to said elbow and a second span extending from said elbow to said distal end;

wherein said elbow is curved upwards at an angle that departs from a horizontal plane that is parallel to a longitudinal axis of said first span, such that a longitudinal axis of said second span extends upwards according to a ray defined by said angle;

and wherein said second span comprises a G-spot stimulating means for stimulating the Grafenberg area when said second span is adapted to be inserted into a vagina of a person, said G-spot stimulating means comprising one or more of a mechanical finger that oscillates in a reciprocal motion within a protuberance that protrudes from a dorsal surface of said second span;

where said G-spot stimulating means further comprises flanges bowing laterally outwards from said elongate body in the second span, said flanges accommodating an expanded internal space within said body within said second span wherein one or more additional mechanical stimulating elements are housed which augment the stimulation of the Grafenberg area by the G-spot stimulating means;

wherein said additional mechanical stimulating elements comprise a pair of vibrating motors, each of said motors being mounted within said flanges on either side of said mechanical finger.

2. The sexual appliance of claim 1, wherein said angle of said elbow is between 45 and 75 degrees.

3. The sexual appliance of claim 2, wherein said angle of said elbow is approximately 65 degrees.

4. The sexual appliance of claim 1, further comprising a second stimulating means, said second stimulating means comprising a scaffold extending upwards from a dorsal surface of said first span and terminating in a brush for providing tactile stimulation to a clitoris of the person when the second span is adapted to be inserted into the vagina.

5. The sexual appliance of claim 4, further comprising a vibrating motor adjacent to said a brush.

6. The sexual appliance of claim 1 further comprising an extension element at the proximal end of said elongate body, said extension element comprising a removeably attachable third span of said elongate body.

7. The sexual appliance of claim 1, further comprising a control panel for controlling an operation of said one or more additional mechanical stimulating elements within said elongate body.

* * * * *